US009493264B1

(12) United States Patent
String

(10) Patent No.: US 9,493,264 B1
(45) Date of Patent: Nov. 15, 2016

(54) COIN ROLL OPENING DEVICE

(71) Applicant: GCCM, LLC, Harrisburg, PA (US)

(72) Inventor: Gregory F. String, Mechanicsburg, PA (US)

(73) Assignee: GCCM, LLC, Harrisburg, PA (US)

( * ) Notice: Subject to any disclaimer, the term of this patent is extended or adjusted under 35 U.S.C. 154(b) by 0 days.

(21) Appl. No.: 14/692,165

(22) Filed: Apr. 21, 2015

(51) Int. Cl.
*B65B 69/00* (2006.01)
*B26B 27/00* (2006.01)

(52) U.S. Cl.
CPC ..... *B65B 69/0033* (2013.01); *B26B 27/005* (2013.01)

(58) Field of Classification Search
CPC ..... Y10T 83/9493; Y10S 83/946; B65B 69/0033; B65B 69/00; B26B 27/005
USPC ..... 30/278, 280, 2, 286, 294
See application file for complete search history.

(56) References Cited

U.S. PATENT DOCUMENTS

| | | | | |
|---|---|---|---|---|
| 4,040,183 | A | 8/1977 | Cassier | |
| 4,106,196 | A * | 8/1978 | Smithline | B26B 27/00 30/286 |
| 5,123,320 | A * | 6/1992 | Hochfeld | B26B 27/00 225/93 |
| 5,992,286 | A * | 11/1999 | Boole | B65B 69/0033 30/280 |
| 2006/0075643 | A1* | 4/2006 | Shafeek | G07D 9/00 30/280 |
| 2010/0000391 | A1* | 1/2010 | Mohamed | B26D 1/025 83/856 |

* cited by examiner

*Primary Examiner* — Phong Nguyen
(74) *Attorney, Agent, or Firm* — Hooker & Habib, P.C.

(57) ABSTRACT

A coin roll opening device includes a support surface and a knife having an elongate cutting edge extending along the support surface. The cutting edge defines a depth of cut that increases from essentially zero at a front end of the cutting edge to a maximum depth of cut away from the front end. A coin roll drive rolls the coin rolls on the support surface over the knife to cut open the coin rolls.

20 Claims, 4 Drawing Sheets

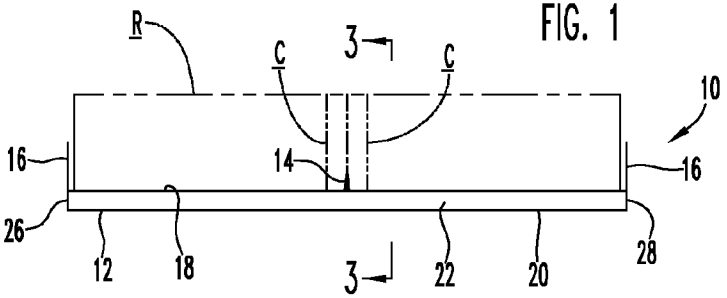
FIG. 1
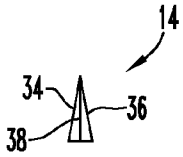
FIG. 2
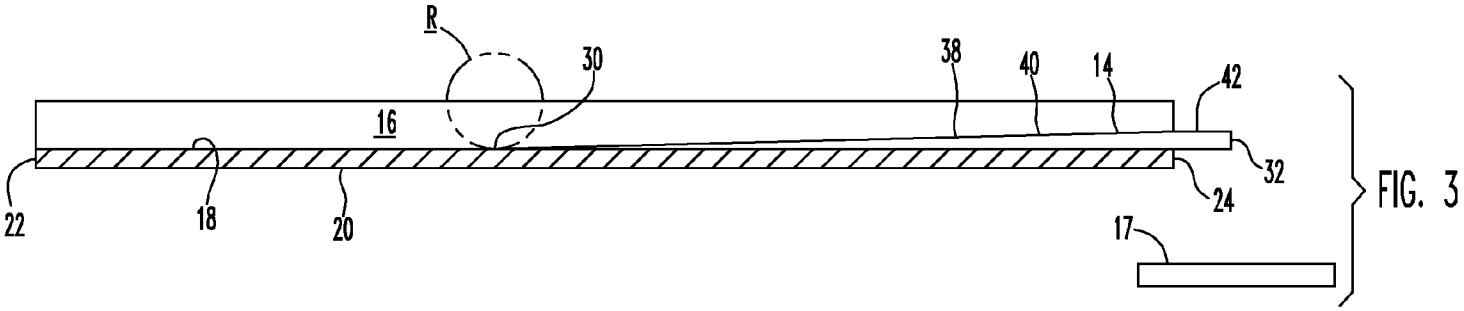

COIN ROLL OPENING DEVICE

FIELD OF THE DISCLOSURE

This disclosure relates to devices that open coin rolls formed by wrapping a stack of coins with a coin wrapper sheet.

BACKGROUND OF THE DISCLOSURE

Coin rolls are formed by wrapping a stack of like coins with a coin wrapper sheet. A coin wrapper sheet is typically a kraft paper or plastic sheet. A coin roll formed from coins of a US coin denomination is conventionally formed from 20, 25, 40, or 50 coins (depending on coin denomination).

Banks, retailers, and others handle and need to open a large number of coin rolls.

Devices that open a large number of coin rolls at the same time include a drum that receives the coin rolls and drives the coin rolls against an abrasive surface. Although useful, such devices take up a lot of room and generate a large amount of airborne waste particles. Removing the coins from the drum can be difficult.

Other devices that open coin rolls are manually operated and are not suitable for opening a large number of coin rolls at a relatively high speed.

Thus there is a need for an improved coin roll opening device that can a open a large number of coin rolls at a relatively high speed while minimizing production of airborne dust and waste. The coin roll opening device should also be able to efficiently open a lower number of coin rolls or even efficiently open a single coin roll if necessary.

SUMMARY OF THE DISCLOSURE

Disclosed is a coin roll opening device that can efficiently open a large number of coin rolls, and can even open a single coin roll efficiently if necessary.

A coin roll opening device for opening a coin roll formed as a stack of coins wrapped in a coin wrapper sheet includes a base and a knife fixed with respect to the base. The base includes a flat support surface for supporting the coin roll.

The knife is fixed with respect to the base and extends along the support surface. The knife includes an elongate exposed cutting edge defining a maximum depth of cut with respect to the cutting surface. The front end of the cutting edge is essentially flush with the support surface and at least a portion of the cutting edge extending away from the front end is inclined with respect to the support surface and extends away from the support surface to gradually increase the depth of cut as the cutting edge extends away from the front end. The length of the cutting edge and the maximum depth of cut is sufficient for the cutting edge to cut through the entire radial thickness and entire circumference of the wrapper sheet when the coin roll is rolled on the support surface over the cutting edge.

Use of a knife instead of an abrasive reduces the generation of airborne dust and waste during the opening process.

It has been found that increasing the depth of cut from essentially zero to the depth of cut needed to cut through and around the entire coin wrapper sheet enables the coin roll to move laterally with respect to the knife cutting edge and places the cutting edge between two immediately adjacent coins of the coin stack in the coin roll. This increases cutting efficiency and reduces marking of the coins by the knife edge.

The portion of the knife forming the cutting edge is preferably wedge-shaped with two surfaces extending away from each other from the cutting edge at an included acute angle. The wedge shape applies a force urging the two immediately adjacent coins on either side of the cutting edge away from each other and assists in opening the coin roll.

In an embodiment the coin roll opening device includes a coin roll drive that includes a coin roll drive member engageable with the coin roll to roll the coin roll on the support surface from the front end of the knife cutting edge towards the back end of the support surface.

In an embodiment the coin roll drive member is formed as a belt run of an endless belt. The belt run simultaneously drives a number of coin rolls to increase the production rate of the device. The compliance of the belt run enables the belt run to drive coin rolls formed of different coin denominations to be opened by the same coin opening device. For example, an embodiment coin roll opening device can simultaneously drive both dime coin rolls and penny coin rolls.

In an additional embodiment, the coin roll opening device could include a movable gate that operates to space apart the coin rolls being driven by the coin roll drive member. This better enables a belt run, for example, to engage and simultaneously drive coin rolls of different diameter.

In a further additional embodiment the knife is disposed in a slot formed in the base, the slot being open to the support surface. The slot may be a through-slot that enables the knife to be mounted on a support member located beneath the base. Because the knife is not directly attached to the base, the relative position of the knife with respect to the support surface can be easily adjusted to accommodate for knife wear or for variations in the coin wrapper sheets (material, number of wraps, or the like) forming the coin rolls.

Other objects and features of the disclosure will become apparent as the description proceeds, especially when taken in conjunction with the accompanying drawing sheets illustrating one or more non-limiting embodiments.

BRIEF DESCRIPTION OF THE DRAWINGS

FIG. 1 is an end view of the base and knife of a first embodiment coin roll opening device;

FIG. 2 is an enlarged end view of the knife shown in FIG. 1;

FIG. 3 is a side sectional view of the base shown in FIG. 1 taken along lines 3-3 of FIG. 1;

DETAILED DESCRIPTION

Figure 4:
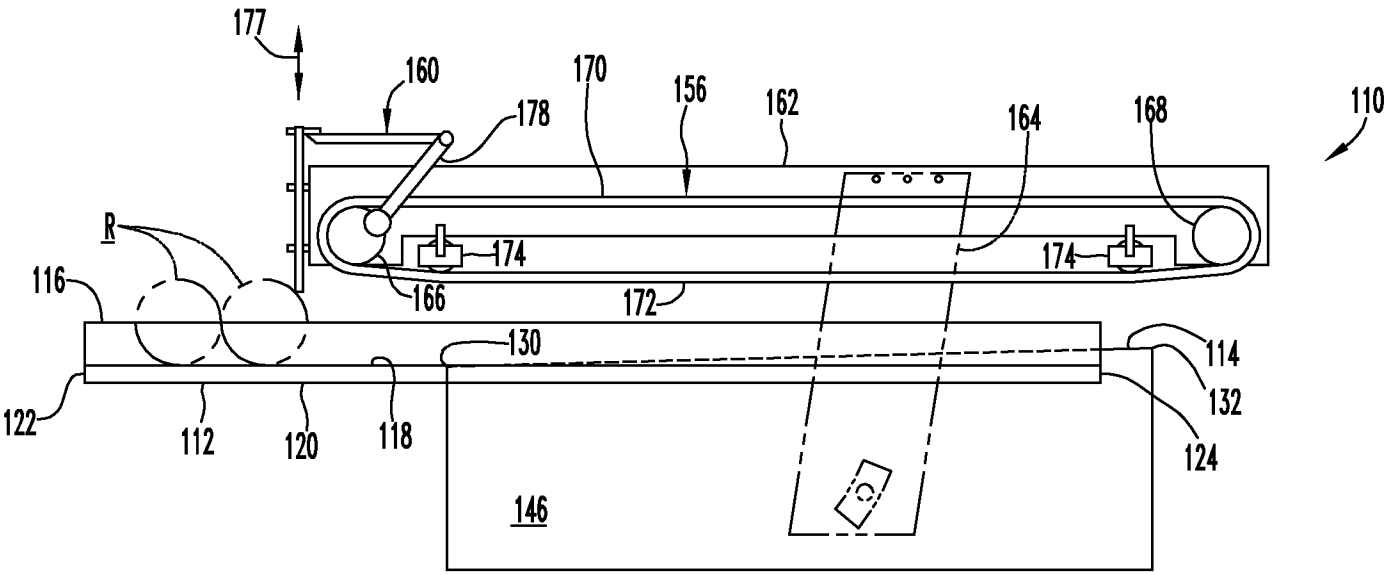
FIG. 4 is a side view of a second embodiment coin roll opening device.

FIGS. 1-3 illustrate portions of a coin roll opening device 10 used for opening coin rolls. A coin roll is formed by wrapping a stack of coins with a coin wrapper sheet. The coin roll opening device 10 includes a base 12 for supporting a coin roll and a knife 14 attached to the base 12. A pair of side walls 16 extend away from the base 12.

Coin rolls are opened by the knife 14 and the opened coin rolls fall by gravity onto a rigid, hard impact surface 17. The opened coin rolls drop a sufficient distance for the impact against the hard, essentially incompressible surface 16 to assist in dispersing coins from the cut wrapper sheet.

Not shown in FIGS. 1-3 is a coin roll drive that is similar to the coin roll drive shown in FIG. 4 and described in greater detail below for a second embodiment coin roll opening device.

The base 12 includes a flat, generally rectangular upper support surface 18 and a bottom surface 20 separated by the thickness of the base. The base 12 extends in the longitudinal direction from a front end 22 to a back end 24 downstream from the front end 22. The base 12 extends transverse to the longitudinal direction between opposite sides 26, 28.

The side walls 16 extend from the sides 26, 28 away from the support surface 18. The width of the support surface 18 is sufficient to enable a coin roll R (shown in phantom lines in FIG. 1) to be received with some clearance between the side walls 16 along the entire length of the support surface from the base front end 22 to the base back end 24.

The knife 14 is an elongate member rigidly attached to the support surface 18 that extends in the longitudinal direction along the support surface 18. The knife 14 extends from a knife front end 30 to a knife back end 32 that overhangs the back end 24 of the base 12. The knife front end 30 is spaced away from the base front end 22.

The knife 14 includes a pair of generally planar surfaces 34, 36 that define an included acute angle between them and meet to define an exposed knife cutting edge 38. The cutting edge 38 extends the length of the knife from the knife front end 30 to the knife back end 32. The front of the cutting edge 38 is essentially flush with the support surface 18. The portion 40 of the cutting edge 38 extending from the knife front end 30 to the support surface back end 24 is inclined with respect to the support surface 18 and extends away from the support surface 18 as the cutting edge portion 40 extends downstream. The portion 42 of the cutting edge 38 extending from the cutting edge portion to the knife back end 32 is generally parallel with the support surface 18.

The inclined cutting edge portion 40 gradually increases the knife's depth of cut (the distance between the support surface 18 and the knife cutting edge 38) as the knife 14 extends to the base back end 24 and defines a maximum depth of cut at the back end of the support surface 16.

FIGS. 1 and 3 illustrate the coin roll R on the support surface 18 to be cut open by the device 10. The coin roll R is introduced onto the front end of the support surface 18 substantially centered between the side walls 16. A conveyor or other convention apparatus to feed singulated coin rolls can be used to feed coin rolls to the device 10.

The side walls 16 are spaced far enough apart to provide some clearance between the walls and the coin roll R. The coin roll drive (not shown) rolls the coin roll R in the direction of the arrow 44 against the support surface 18 to the base back end 24. The coin roll R rolls on the support surface 18 over the knife cutting edge 38, forcing the cutting edge 38 to penetrate and cut the coin wrapper sheet. The cutting edge 38 is capable of cutting around the entire circumference of the coin wrapper sheet and cutting through the entire radial thickness of the coin wrapper sheet when the coin roll R is rolled on the support surface 18 from the knife front end 30 to the back end 24. Coin wrapper sheets are typically wound twice around a coin stack and so the length of the illustrated cutting edge 40 is sufficient for the knife 14 to cut through the entire circumference of the two layers of the coin wrapper sheet.

FIG. 1 illustrates the knife cutting edge 38 centered between two immediately adjacent coins C of the coin roll R. The depth of cut at the front end of the knife is essentially zero and increases to a maximum depth of cut some distance away from the front end of the knife. This enables the cutting edge 38 to gradually ease into the coin roll R as the coin roll rolls on the support surface 18 over the front end of the knife to the base back end 24. It was found that by having an initial depth of cut not sufficient to cut through the entire radial thickness of the coin wrapper sheet and then easing the knife cutting edge into the coin roll to cut through the entire thickness of the coin roll wrapper sheet enables the coin roll to move or "wiggle" laterally towards one or the other side wall 16 as the coin roll begins moving over the knife's exposed cutting edge. This causes the coin roll to locate itself with respect to the cutting edge 38 with the cutting edge moving between two immediately adjacent coins C of the coin roll R—even if the knife cutting edge 38 is not initially centered between a pair of coins C of the coin roll R when the coin roll R reaches the front end of the knife.

As the cutting edge 38 enters the coin roll R, the depth of cut increases to where the cutting edge 38 cuts through the coin wrapper sheet and moves between the immediately adjacent pair of coins C. The knife edge walls 34, 36 urge the pair of coins apart from one another as the depth of cut increases, assisting in the opening of the coin wrapper sheet and in separating the two portions of the coin stack on opposite sides of the knife 14.

The length and depth of cut of the cutting edge 38 in the illustrated embodiment is such that the coin wrapper sheet of the coin roll R is completely cut open and the two halves of the coin roll are moving apart from each other by the time the coin roll reaches the base back end 24.

The two cut halves of the coin roll R fall off the base 12 and fall onto the impact surface 17. The impact force urges the coins in each cut coin roll half to separate from the cut coin roll wrapper. The coins and cut coin wrapper sheets slide off the impact surface 17 for further processing.

Should a coin wrapper sheet of a coin roll R not be completely cut through before the coin roll R reaches the support surface 22, the coin roll drive rolls the coin roll R onto the overhanging portion 42 of the knife cutting edge to complete cutting of the coin wrapping sheet.

The illustrated coin roll opening device 10 is designed to receive and open both dime and penny coin rolls. Other embodiments of the coin roll opening device 10 are designed to receive and open other coin rolls of other denominations, and can be designed to receive and open more than one denomination of coin roll if the diameter and length of the different denomination coin rolls are sufficiently close to one another. In a high production environment a number of coin roll opening devices 10 can be placed side-by-side to process coin rolls in parallel. Coin roll devices similar to the device 10 but designed to open other denominations of coin rolls can be included in the side-by-side arrangement of devices.

Figure 5:
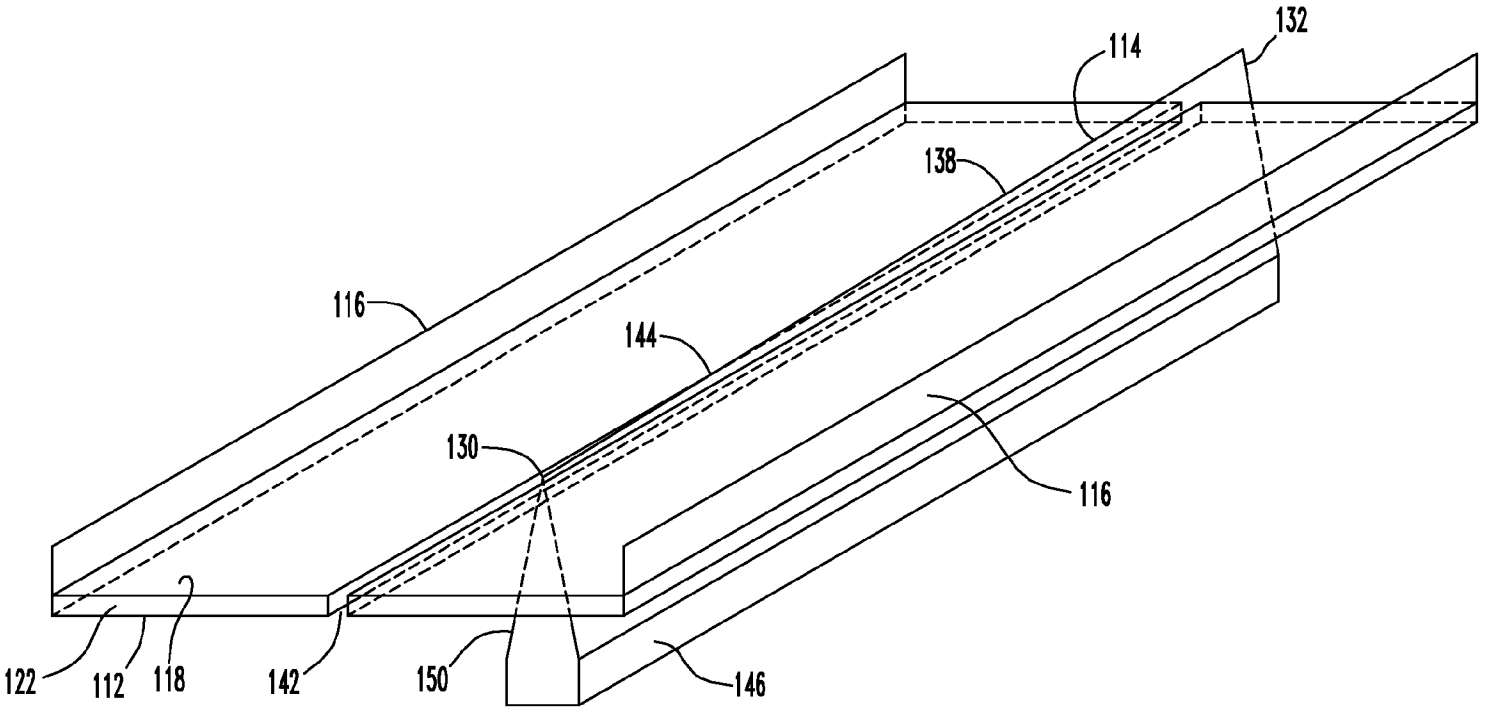
FIG. 5 is an isometric view of the base and anvil of the coin roll opening device shown in FIG. 4.
Figure 6:
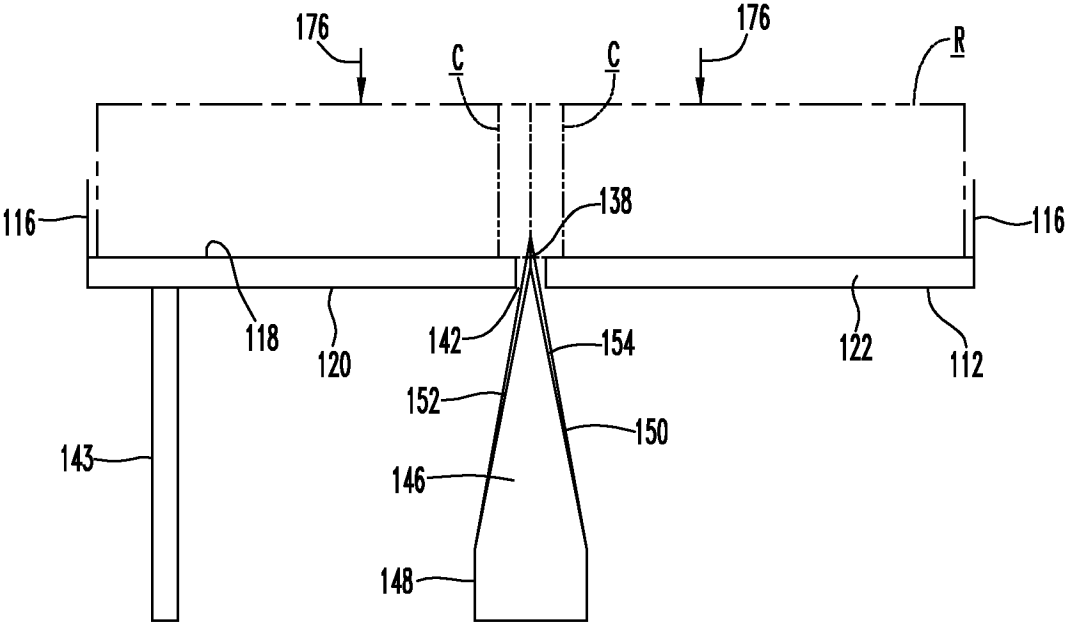
FIG. 6 is an end view of the base and anvil shown in FIG. 5.

FIGS. 4-6 illustrate a second embodiment coin roll opening device 110. The coin roll opening device 110 includes a base 112 similar to (but not identical to) the base 12 and a knife 114 for cutting the coin wrapper sheet. In this embodiment the knife 114 is not directly attached to the support surface of the base 112 to facilitate relative positioning of the base 112 with respect to the knife 114.

The base 112 includes a support surface 118 and a lower surface 120 separated by the thickness of the base 112. The support surface 118 is similar to the support surface 18 and extends from a base front end 122 to a base back end 124. Side walls 116 identical to the side walls 16 extend away from the support surface 118.

In this embodiment a through-slot 142 is formed in the base 112. The slot 142 extends through the thickness of the base 112 and extends in the longitudinal direction parallel to the side walls 116 from the base front end 122 to the base back end 124. The base 112 is supported on a frame or legs 143 (only one leg 143 is shown in FIG. 6).

The knife 114 is partially disposed in the slot 142. The knife 114 extends from a knife front end 130 in the slot 142 and past the back end 124 to a knife back end 132 that is spaced away from the back end 124. The knife front end 130 is spaced away from the base front end 122.

The knife 114 includes a cutting edge 138 similar to the knife cutting edge 38. The cutting edge 138 extends the length of the knife from the knife front end 130 to the knife back end 132. The front of the cutting edge 138 however in this embodiment is in the slot 142 and is spaced a short distance below the support surface 118. The entire length of the cutting edge 138 from the knife front end 130 to the knife back end 132 is inclined with respect to the support surface 118 in a similar manner as the as the inclined cutting edge portion 40 previously described above. The exposed portion of the cutting edge 138 extends from a point 144 where the cutting edge 138 is extending out of the slot 142 and is essentially flush with the support surface 118 to the knife back end 132. The depth of cut defined by the cutting edge 138 with respect to the support surface 118 continuously increases from the point 144 to the knife back end 132.

The knife 114 is integrally formed with an anvil 146 that is located beneath the base 112 and is aligned with the slot 142. The weight of the anvil 146 acts to fix the position of the knife 114 with respect to the supporting surface 118 during operation of the device 110.

The anvil 146 in the illustrated embodiment is made of steel and includes a relatively wide support base 148 that supports the anvil 146 on the work floor and a wedge-shaped portion 150 that has two side surfaces 152, 154 that extend from below the base lower surface 120 and into the slot 142. The two side surfaces 152, 154 define an acute included angle between them and meet to form the knife cutting edge 138.

The frame or legs 143 positions the support surface 118 in the desired position and orientation with respect to the cutting edge 138. Adjustments to the positioning of the support surface 118 can be made without moving the anvil 146.

In other embodiments the knife 114 can be formed in a manner similar to the knife 14 and mounted on top of the anvil 146 rather than being integrally formed with the anvil 146. This enables the anvil 146 to be made of a material not necessarily suitable for forming a knife edge.

The coin roll opening device 110 further includes a coin roll drive 156 and a movable gate 158 that is driven between open and closed positions by a gate drive 160.

The coin roll drive 156 includes an elongate mounting bracket 162 that is mounted directly above and extends parallel with the slot 142 by a mounting assembly 164 shown in phantom in FIG. 4. The illustrated mounting assembly connects the bracket 162 to the anvil base 148, but in other embodiments the bracket 162 is supported independently of the anvil and may be supported independently of the base 112. The mounting assembly 164 in the illustrated embodiment permits fine adjustment of the height and inclination of the bracket 162 with respect to the support surface 118.

The coin roll drive 156 includes a pair of belt assemblies mounted on opposite sides of the bracket 162 that are driven by an electric motor (not shown). FIG. 4 illustrates a belt assembly on one side of the bracket 162. Each belt assembly includes an upstream pulley 166 disposed between the front base end 122 and the front end of the knife 114 and a downstream pulley 168 spaced away from the base back end 124 and the knife back end 132. The pulleys 166, 168 support an endless belt 170 having a lower belt run 172 that extends from the pulley 166 to the pulley 168 and is spaced to one side of the slot 142 above the support surface 118. Spring-loaded belt tensioners 174 urge the lower belt run 172 towards the support surface 118.

The gate 158 is attached to the bracket 162 and is movable along a path indicated by the double-headed arrow 177 between a closed position shown in FIG. 4 and an opened position further away from the base 112. The gate 158 is located between the base front end 122 and the knife front end 130 and is spaced from the front end 122. As shown in FIG. 4, the gate 158 is spaced a sufficient distance from the front end 122 to enable a number of coin rolls R to be supported on the support surface 118 upstream from the gate 158. The support surface 118 slopes downwardly slightly so that gravity urges coin rolls on the support surface 118 to roll towards the base back end 124. When in the closed position the gate 158 obstructs coin rolls R on the support surface 118 from rolling past the gate. When in the raised position the gate 158 does not obstruct rolling of coin rolls R on the support surface 118 past the gate.

The gate drive 160 includes a linkage mechanism 178 that connects the gate 158 to the upstream pulley 166 and converts rotary motion of the pulley to oscillating linear motion of the gate 158. Motion of the gate 158 in the illustrated embodiment is synchronized with the normal rotation speed of the pulley 166 to allow only one coin roll R to move past the gate 168 between successive closed positions of the gate 168.

In operation the coin roll drive moves the lower belt runs 172 in the downstream direction at an operating speed. When the gate 168 moves to the opened position, a coin roll R rolls past the gate 168 and below the upstream pulleys 166. The upstream pulleys 166 are spaced above the support surface 118 with sufficient clearance to enable the coin roll R to move under the pulleys and into engagement with the lower belt runs 172. The belt tensioners 174 urge the belt runs 172 against the support surface 118 with sufficient force to roll the coin roll past the knife 114 and to the base back end 124. FIG. 5 illustrates each belt run 172 applying a force represented by the arrow 176 to the two halves of the coin roll R on opposite sides of the knife 114. The compliance of the belt runs 172 also enable coin rolls of different denominations (but sufficiently close diameters) to be opened by the same coin opening device 110.

The belt runs 172 press the coin roll R against the support surface 118 and roll the coin roll R downstream against the knife cutting edge 138. The cutting edge 138 eases into the coin wrapper sheet to enable the coin roll R to wiggle laterally as needed to place the cutting edge between two immediately adjacent coins of the coin roll as previously described. The belt run 172 extends beyond the back end 132 so that the coin roll can move the full length of the cutting edge 138 if necessary to fully cut the coin wrapper sheet.

The illustrated coin roll drive utilizes a belt run as a coin roll drive member that engages and moves coin rolls against the support surface. Other embodiments of the coin roll drive may utilize a number of separate, spaced apart drive members attached to a chain or like drive that are synchronized with the opening and closing of the gate to separately engage and drive a respective coin roll along the support surface.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art and fall within the purview of the following claims.

What is claimed is:

1. A device for opening a coin roll formed as a stack of coins wrapped in a coin wrapper sheet, said device comprising:

a base comprising a support surface, the support surface comprising a front end and a back end spaced in a longitudinal direction away from the front end;

a knife extending along the support surface, the knife comprising an elongate cutting edge defining a maximum depth of cut with respect to the support surface, the cutting edge extending longitudinally away from the front end of the support surface from a front end of the cutting edge to a back end of the cutting edge, the front end of the cutting edge being substantially flush with the support surface, the cutting edge being inclined with respect to the support surface and extending away from the support surface to gradually increase the depth of cut of the cutting edge with respect to the support surface from a first essentially zero depth of cut to a second non-zero depth of cut as the cutting edge extends towards the back end of the cutting edge, the length of the cutting edge and maximum depth of cut sufficient for the cutting edge to cut through the entire radial thickness and entire circumference of the wrapper sheet when the coin roll is rolled on the support surface over the cutting edge; and a coin roll drive comprising at least one coin roll drive member, each drive member engageable with the coin roll to roll the coin roll on the support surface from the front end of the knife cutting edge towards the back end of the support surface.

2. The device of claim 1 wherein the coin roll drive member comprises a first endless belt extending in the longitudinal direction, the first endless belt comprising a first belt run facing the support surface and engageable with the coin roll to roll the coin roll on the support surface.

3. The device of claim 2 wherein the coin roll drive member comprises a second endless belt extending in the longitudinal direction, the second endless belt run comprising a second belt run facing the support surface and engageable with the coin roll to roll the coin roll on the support surface, the first and second belt runs being disposed on opposite sides of the knife cutting edge.

4. The device of claim 1 wherein the knife is not attached to the base.

5. The device of claim 4 wherein the knife is mounted on a support disposed beneath the base.

6. The device of claim 5 wherein the knife and the support are formed together from a single piece of metal.

7. The device of claim 1 wherein the cutting edge of the knife overhangs the back end of the support surface.

8. The device of claim 1 wherein the base comprises a lower surface and a slot, the lower surface being spaced from the support surface by a thickness of the base, the slot extending from the front end of the support surface to the back end of the support surface, and the slot extending through the thickness of the plate from the support surface to the lower surface whereby the support surface comprises a first support surface portion and a second support surface portion, the first and second support surface portions being separated from one another by the slot.

9. The device of claim 1 comprising a pair of spaced-apart side walls extending from the support surface away from the support surface, the knife being disposed between the pair of side walls.

10. The device of claim 9 wherein the pair of side walls extend from the front end of the support surface to the back end of the support surface.

11. The device of claim 1 wherein the entire support surface is flat.

12. A device for opening a coin roll formed as a stack of coins wrapped in a coin wrapper sheet, said device comprising:

a base comprising a support surface, the support surface comprising a front end and a back end spaced in a longitudinal direction away from the front end;

a knife extending along the support surface, the knife comprising an elongate cutting edge defining a maximum depth of cut with respect to the support surface, the cutting edge extending longitudinally away from the front end of the support surface from a front end of the cutting edge to a back end of the cutting edge, the front end of the cutting edge being substantially flush with the support surface, the cutting edge being inclined with respect to the support surface and extending away from the support surface to gradually increase the depth of cut of the cutting edge with respect to the support surface from a first essentially zero depth of cut to a second non-zero depth of cut as the cutting edge extends towards the back end of the cutting edge, the length of the cutting edge and maximum depth of cut sufficient for the cutting edge to cut through the entire radial thickness and entire circumference of the wrapper sheet when the coin roll is rolled on the support surface over the cutting edge;

the front end of the knife cutting edge being spaced in the longitudinal direction away from the front end of the support surface; and a gate being disposed between the front end of the support surface of the base and the front end of the knife cutting edge, the gate being movable between a closed position wherein the gate obstructs rolling of the coin roll from the front end of the support surface to the knife cutting edge and an opened position wherein the gate does not obstruct rolling of the coin roll from the front end of the support surface to the knife cutting edge, and a gate drive attached to the gate that moves the gate between opened and closed positions.

13. The device of claim 12 wherein the gate drive is configured to allow only one coin roll at a time to roll past the gate between successive closings of the gate.

14. The device of claim 13 wherein the support surface is inclined with respect to gravity wherein gravity urges a coin roll on the support surface at the front end of the support surface to roll towards the knife.

15. The device of claim 13 comprising a coin roll drive that engages a coin roll on the support surface and urges the coin roll towards the back end of the support surface, movement of the gate being synchronized with the coin roll drive.

16. The device of claim 15 wherein the coin roll drive comprises an endless belt extending between a pair of pulleys and the gate drive further comprises a linkage mechanism attached to one of the said pulleys and attached to the gate, the linkage mechanism being disposed to convert rotary motion of the one pulley to linear motion of the gate.

17. The device of claim 12 wherein the base comprises a lower surface and a slot, the lower surface being spaced from the support surface by a thickness of the base, the slot extending from the front end of the support surface to the back end of the support surface, and the slot extending through the thickness of the plate from the support surface to the lower surface whereby the support surface comprises a first support surface portion and a second support surface portion, the first and second support surface portions being separated from one another by the slot.

18. The device of claim 12 comprising a pair of spaced-apart side walls extending from the support surface away from the support surface, the knife being disposed between the pair of side walls.

19. The device of claim 18 wherein the pair of side walls extend from the front end of the support surface to the back end of the support surface.

20. The device of claim 12 wherein the entire support surface is flat.

* * * * *